US008127854B2

(12) United States Patent
Håheim

(10) Patent No.: US 8,127,854 B2
(45) Date of Patent: Mar. 6, 2012

(54) SYSTEM AND METHOD FOR RIGGING UP WELL WORKOVER EQUIPMENT

(75) Inventor: Svein A. Håheim, Oslo (NO)

(73) Assignee: Vetco Gray Scandinavia AS, Sandvika (NO)

( * ) Notice: Subject to any disclaimer, the term of this patent is extended or adjusted under 35 U.S.C. 154(b) by 240 days.

(21) Appl. No.: 11/578,558

(22) PCT Filed: Apr. 18, 2005

(86) PCT No.: PCT/IB2005/001028

§ 371 (c)(1),
(2), (4) Date: Jul. 26, 2007

(87) PCT Pub. No.: WO2005/100737

PCT Pub. Date: Oct. 27, 2005

(65) Prior Publication Data

US 2007/0284113 A1 Dec. 13, 2007

Related U.S. Application Data

(60) Provisional application No. 60/562,629, filed on Apr. 16, 2004.

(51) Int. Cl.
*E21B 17/01* (2006.01)

(52) U.S. Cl. ..... 166/367; 166/339; 166/344; 166/345; 166/352; 166/365

(58) Field of Classification Search ..... 166/367, 166/339, 340, 344, 345, 350, 365, 366, 368; 114/264; 441/3–5

See application file for complete search history.

(56) References Cited

U.S. PATENT DOCUMENTS

| | | | | |
|---|---|---|---|---|
| 3,981,369 | A * | 9/1976 | Bokenkamp | 175/5 |
| 4,117,941 | A * | 10/1978 | McCleskey et al. | 414/22.63 |
| 4,368,871 | A | 1/1983 | Young | |
| 5,819,852 | A * | 10/1998 | Cunningham et al. | 166/345 |
| 5,941,310 | A * | 8/1999 | Cunningham et al. | 166/345 |
| 5,960,885 | A * | 10/1999 | Edwards et al. | 166/345 |
| 6,129,151 | A * | 10/2000 | Crotwell | 166/359 |
| 6,453,838 | B1 * | 9/2002 | Mowell et al. | 114/230.13 |
| 6,457,540 | B2 * | 10/2002 | Gardes | 175/62 |
| 6,745,855 | B2 * | 6/2004 | Gardes | 175/62 |
| 7,040,408 | B2 * | 5/2006 | Sundararajan et al. | 166/368 |
| 7,040,411 | B2 * | 5/2006 | Kainer et al. | 166/379 |
| 7,086,474 | B1 * | 8/2006 | Trevithick et al. | 166/379 |
| 7,163,064 | B2 * | 1/2007 | Moncus et al. | 166/379 |
| 7,380,609 | B2 * | 6/2008 | Page et al. | 166/387 |
| 2004/0094305 | A1 * | 5/2004 | Skjæ rseth et al. | 166/339 |
| 2004/0182297 | A1 * | 9/2004 | Wybro et al. | 114/230.1 |
| 2004/0251029 | A1 * | 12/2004 | Horton, III | 166/345 |
| 2005/0028980 | A1 * | 2/2005 | Page et al. | 166/285 |
| 2005/0121198 | A1 * | 6/2005 | Andrews | 166/368 |

(Continued)

*Primary Examiner* — Thomas Beach
*Assistant Examiner* — Matthew R Buck
(74) *Attorney, Agent, or Firm* — Venable LLP; Eric J. Franklin

(57) ABSTRACT

A gas and oil recovery system including a vessel, platform or rig, with a rig floor, a riser including a pipe that extends from the vessel, platform or rig to a x-mas tree on top of a well head and via which a wire or coiled tubing is fed down into a well. The riser is movable through an opening in the rig floor, and a surface flow head connected to the riser and to a wire line or coiled tubing equipment. The surface flow head is arranged to be run through the opening in the rig floor.

18 Claims, 11 Drawing Sheets

U.S. PATENT DOCUMENTS

2005/0207849 A1* 9/2005 Roodenburg et al. ..... 405/166
2006/0060360 A1* 3/2006 Moncus et al. ..... 166/386
2006/0191716 A1* 8/2006 Humphreys ..... 175/5
2006/0219411 A1* 10/2006 Moksvold ..... 166/345
2006/0237189 A1* 10/2006 Page et al. ..... 166/250.01
2008/0121429 A1* 5/2008 Bamford ..... 175/5

* cited by examiner

SYSTEM AND METHOD FOR RIGGING UP WELL WORKOVER EQUIPMENT

CROSS-REFERENCE TO RELATED APPLICATIONS

This application claims priority to U.S. provisional patent application 60/562,629 filed 16 Apr. 2004 and is the national phase under 35 U.S.C. §371 of PCT/IB2005/001028 filed 18 Apr. 2005.

FIELD OF THE INVENTION

The present invention relates to a gas and oil recovery system for rigging up well workover equipment, comprising a platform, vessel or rig, with a rig floor, a riser, comprising a pipe that extends from the vessel, platform or rig to a subsea x-mas tree on top of a well head and via which a wire or coiled tubing is fed down into a well, said riser being movable through an opening in said rig floor, and a surface flow head connected to the riser on one hand and to a wire line or coiled tubing equipment on the other hand. In particular, the platform, rig or vessel is a floating construction.

The present invention also relates to a method of rigging up a gas and oil recovery system comprising well workover equipment according the invention.

In particular, the present invention relates to a system and method that can address problems associated with establishing and maintaining connections between individual workover equipment components during vessel movement due to movement of the sea surface.

BACKGROUND OF THE INVENTION

Subsea wells need maintenance and inspection activities at a regular basis. Such activities can be carried out by means of tools delivered to the well via a wire or coiled tubing that extends from a floating vessel or a platform down into the well. A coiled tubing typically is a continuous and flexible tubing. The coiled tubing may be made of a metallic material or a corresponding material, such as composites. Typical maintenance and inspection activities in the well are measurements and monitoring of well conditions, perforating, gravel packing, production stimulation and repair of a downhole completion or production tubing.

The open sea represents a harsh environment where wind and wave action can greatly alter the position of a ship from one moment to the next. Movement of the open water workover riser surface flowhead due to vessel movement complicates rig-up of well workover equipment on top. A riser is a pipe that extends from the vessel to a subsea x-mas tree on the top of the well head, via which a wire or coiled tubing is fed down into the well. This is particularly an issue with rig up of coiled tubing (CT), where the equipment is heavy. Rig up/rig down involves deploying/retracting a coiled tubing/toolstring, which might be difficult upon heaving motion of the vessel.

OBJECTS OF THE INVENTION

It is an object of the present invention to present a gas and oil recovery system that makes the rigging of parts of such a system upon heaving vessel movement at sea simpler and safer than do contemporary systems. Especially, the invention should facilitate the rigging up of elements on top of the surface flow head.

It is also an object of the invention to present a corresponding method of rigging up at least parts of a rig system upon heaving vessel movement at sea, by which the rigging up becomes simpler and safer than with contemporary methods of prior art. Especially, the invention should facilitate the rigging up of elements on top of the surface flow head.

BRIEF DESCRIPTION OF THE INVENTION

The object of the invention is achieved by means of the initially defined system, characterised in that the surface flow head is arranged to be run through the opening in the rig floor. Normally, the opening in the rig floor is located in a rotary table that forms part of the floor.

Preferably, the surface flow head comprises a ball valve arranged in a main bore thereof. Thereby, a more slender surface flow head can be achieved than with a conventional gate valve, and, accordingly, it will be easier to let the flow head run through the opening in the rig floor.

For the same reason, it is preferred that the surface flow head is provided with outlets provided with connecting means for the connection thereof to the hoses and valves of a kill line and a choke line respectively. Since kill and choke valves are not incorporated in the flow head, a more slender structure is possible to achieve.

According to one embodiment, the system, below the rig floor, comprises a cellar deck at the level of which the connection of the kill and choke lines to the surface flow head is to take place. This feature adds to the versatility of the flow head and facilitates the displacement of the latter through the opening or hole in the rig floor.

According to a preferred embodiment, the system comprises a retractable coiled tubing injector and a moveable stripper assembly connected on top of the surface flow head. Thereby, it will be possible to avoid lifting a coiled tubing blowout preventer and a stripper assembly connected to the surface flow head above the opening/hole in the rig floor when changing toolstrings.

The moveable stripper assembly is connected to the surface flow head through a well barrier package and a lubricator pipe.

According to one embodiment, the system comprises a lifting arrangement on the cellar deck, for lifting at least one of a coiled tubing injector, a moveable stripper housing, and a well barrier package onto or off from the surface flow head at the cellar deck level.

According to one alternative solution, the system comprises a sliding arrangement at the cellar deck level, for sliding at least one of a coiled tubing injector, a moveable stripper housing, and a well barrier package onto and off from the surface flow head at the cellar deck level.

Preferably the surface flow head is provided with a swivel means that allows it to be rotated independently in relation to the riser.

According to the invention, the riser is suspended in the rig floor by means of riser tensioning means connected to the rig floor and to the riser.

The object of the present invention is also achieved by means of the initially defined method, characterised in that the surface flow head is connected to the riser and that the surface flow head is permitted to run through the opening in the rig floor during subsequent operation, in particular before or during rigging of the equipment on top the surface flow head.

According to one embodiment a coiled tubing blow out preventer, a stripper and a coiled tubing injector are positioned on top of the surface flow head by being lowered through the opening in the rig floor.

According to an alternative embodiment, a retractable coiled tubing injector, a coiled tubing blow out preventer and a moveable stripper assembly are positioned on top of the surface flow head by being lowered through the opening in the rig floor.

According to a further embodiment, a retractable coiled tubing injector, a coiled tubing blow out preventer and a moveable stripper assembly are positioned on top of the surface flow head from a position on a cellar deck level below the rig floor.

According to one embodiment of the invention, the Through Rotary Surface Flow Head (TRSFH) is attached to the workover riser (WR) and a landing joint, and run through rotary to the cellar deck level. There, kill and choke lines are connected, in the same manner as on a drilling Blow Out Preventer (BOP). Also the riser tensioners are connected to a tensioner ring below the TRSFH. The WR is then landed. After landing, riser support is transferred to the riser tensioners, and the landing joint is released from top of the surface flow tree.

In particular, preferred embodiments of the present invention provide a number of different alternative arrangements for rigging up a system to address the problems associated with vessel movement.

BRIEF DESCRIPTION OF THE DRAWINGS

Objects and advantages of the present invention will be more clearly understood from the following specification when considered in conjunction with the accompanying drawings, in which.

DETAILED DESCRIPTION OF THE INVENTION

Figure 1:
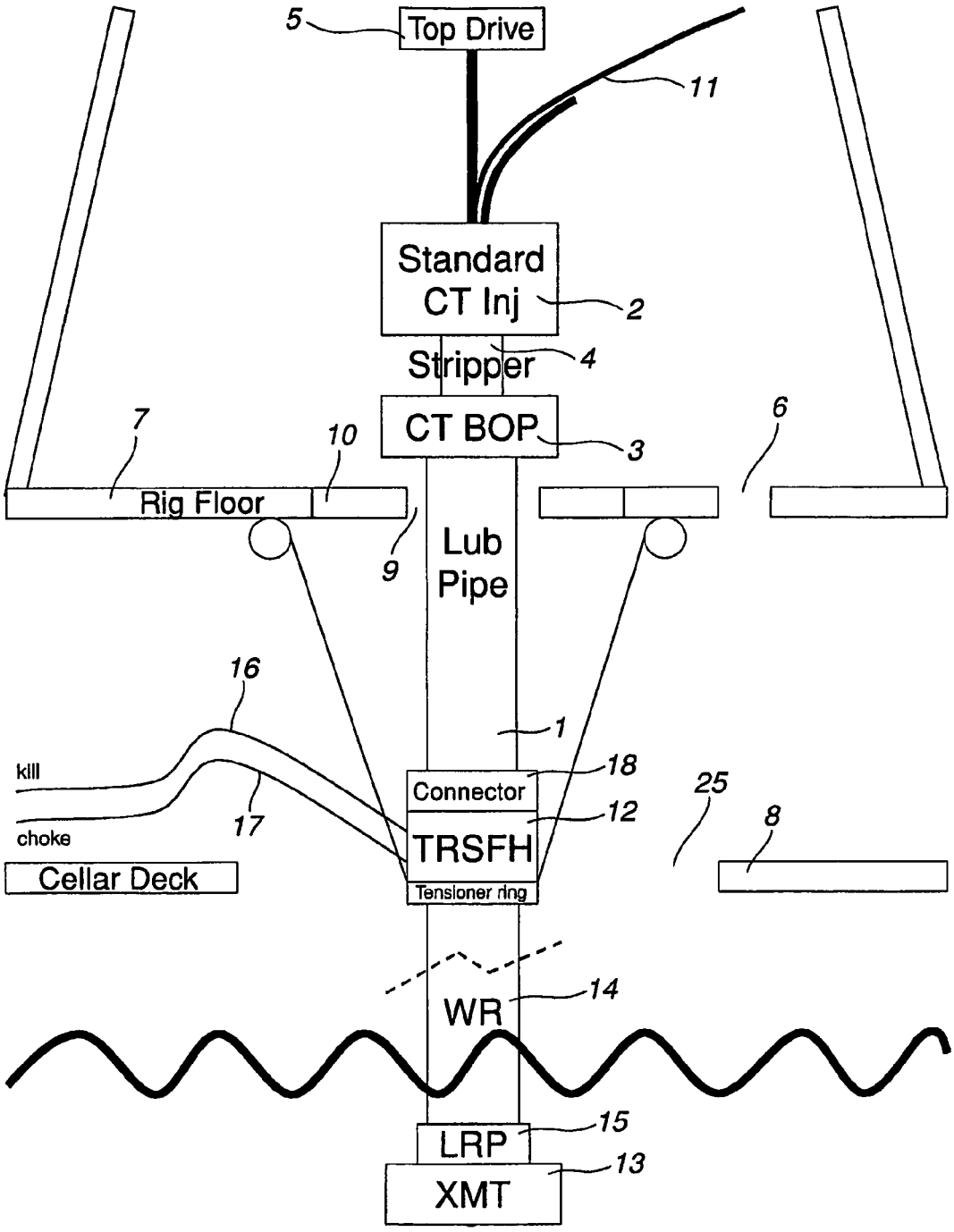
FIG. 1 represents a cross-sectional view of an embodiment of a system according to the present invention.

In order to facilitate the understanding of the following detailed description, some elements that are commonly used in a gas or oil recovery system will be explained more in detail as to their main functions and main components. Not all of these elements are essential for the present invention, but should be mentioned anyhow for the sake of clarity.

Surface Flow Head, SFH (also named Surface Flow Tree, SFT): acts as a coupling or crossover between the Workover Riser and the wireline or Coiled Tubing equipment (the Coiled Tubing WBP or Lubricator Pipe) arranged on top of the SFH, with inlets for the Kill and choke lines respectively. The SFH mainly comprises a pressure containing body with one valve in the main bore and two side outlets with valves. The Kill and choke lines are attached to each of these outlets. The lower end of the SFH is equipped with a swivel, which allows it to be rotated independently with relation to the Workover Riser (around an axis running through the riser). A standard SFT is usually equipped with a flange in each end.

Well Barrier Package, WBP: is a form of BOP, used as a barrier element, i.e. a means of shutting off the access to the well in order to prevent hydrocarbons to escape out of the well. The WBP is a safety device, which is commonly comprise two to four different rams of the following types: Blind ram, Pipe ram, Shear ram, Slip ram. Combinations such as Shear & Seal (Blind) ram or Pipe & Slip ram are also common.

BOP Rams: are used to close the bore in a quick and safe manner. A ram in this context comprises two blades that are moved towards each other by the use of hydraulic cylinders. The objective is to close the bore like a gate. If the bore is empty a couple of blind rams will seal it, if a pipe or Coiled Tubing is inside a shear/seal ram will cut the pipe and seal off the bore whereas a pipe ram will seal around any pipe in the bore.

Workover Riser, WO Riser: is a pipe used to connect the subsea x-mas tree to the rig at surface. It is made up of several joints that are made up to each other on the rig and the whole string is built up from the rig and down to the x-mas tree. A Workover Riser usually consists of a main bore and an annulus bore. Common main bore size ranges between 5 inches and 7⅜ inches. The annulus bore is often 2 inches. An umbilical cable containing hydraulic and electrical lines for operation of valves and connectors is often clamped to the riser.

Lower Workover Riser Package, LWRP (LRP): is used together with the Emergency Disconnect Package (EDP) to connect the Workover Riser to the x-mas tree and also to act as a barrier element when the x-mas tree is opened for access to the well. A connector that fits the mandrel on the x-mas tree is fitted in the lower end. The upper end is fitted with a mandrel onto which the connector of the EDP fits. It contains valves for closing both the main bore and the annulus bore. It is also equipped with a shear seal ram, which is capable of cutting any wire, tool or coiled tubing that is run through it during workover and establish a leak proof seal. In an emergency situation this ram will be used to close in the well and prevent any leakage of hydrocarbons from the well.

Emergency Disconnect Package, EDP: As the name implies the Workover Riser may be disconnected from the LRP and pulled in an emergency situation. In such a situation the EDP will close the lower end of the riser and the LRP will close off the x-mas tree. The EDP will be pulled together with the riser and a LRP will remain on the x-mas tree. The lower end is fitted with a connector that fits a LRP mandrel and the upper end is fitted with a mandrel that fits the Stress Joint connector. The stress joint is the lowest riser joint, onto which the rest of the riser is built. In addition to this the EDP comprises a valve that is used to close the main bore.

Stripper Assembly: A stripper is used to form a seal around coiled tubing as this is being run into the well or pulled out of the well. This seal is usually made of some sort of elastomer (synthetic rubber), which often has the shape of two halves that has a length of for example 4 inches and fits tightly around the CT. A piston is used to squeeze this elastomer packing around the CT in order to form a leak proof seal.

Stripper Housing Houses the stripper and the activation mechanism. It mainly comprises a housing for the elastomer packing and the activation mechanism with an activation piston.

Lubricator Pipe: A piece of pipe, which can be closed in both ends. It is used for transporting a CT tool from the outside and into the riser. It mainly comprises a pipe with an even inner diameter, a connector in the lower end and either a mandrel or a flange in the upper end.

Coiled Tubing, CT: is used to enable transportation of fluid from the rig and deep down into the well. The CT is also used to deploy different types of tools into the well. It may also be used to carry a drilling machine. The CT mainly comprises a tubing with an outer diameter commonly ranging from 1 inch to 3, 5 inches made of soft steel which enables the tubing to be wound on a reel in a similar manner as would be done with a cable.

CT Blow Out Preventer, BOP: is used to shut off the main bore in an emergency and hence prevent a blow out of the well. It is a safety device. It is used both during drilling and workover. The BOP mainly comprises a set of rams (see above). Often, a so-called bag preventer is also included in addition to the rams. The bag is made of elastomer and may be squeezed to seal around a pipe.

Kill Line: is used to pump heavy fluid into the well in order to kill it. This is done in order to prevent any blow out to evolve. The kill line mainly comprises a high-pressure hose or pipe with valves.

Choke Line: is used to take the return from the well and choke it down to a pressure that can be easily handled by a mud return system on the rig. The choke line mainly comprises a high-pressure hose or pipe with valves.

Gooseneck: A guide for the CT, which makes sure that the bending radius of the CT is kept sufficiently large to prevent any kinks in the CT. The shape is reminding of a gooses neck. The gooseneck mainly comprises a guide usually made up of two arcs with rollers in between onto which the CT glides as it moves into the well and out of the well.

FIG. 1 illustrates an embodiment of the present invention. According to this embodiment, a lubricator pipe 1 is hung off in a riser spider 23 (see FIG. 2). A coiled tubing (CT) injector 2, a coiled tubing blow out preventer (CT BOP) 3, also referred to as a well barrier package (WBP), and two strippers 4 (main and backup) are lifted in by the top drive 5 and connected. The top drive 5 is a motor-driven mechanical driving device for lifting/lowering and rotating the equipment connected thereto. A coiled tubing toolstring is made up in a so called rigfloor mousehole 6, which is a small opening in the rig floor 7 that is utilized for building long assemblies, e.g. toolstrings. The rig floor 7 and a cellar deck 8 located below the rig floor form a central part of a vessel or ship (not shown). The rig floor 7 is usually elevated, provided with an opening 9 in a rotary table 10 that forms a part of the rig floor 7, and located in the center of the vessel. The rotary table 10 may be rotated in order to orient a workover string correctly in relation to a subsea x-mas tree. The spider 23 from which the lubricator pipe 1 is suspended is fixed in the rotary table 10. The derrick is at tower (not shown) that typically is built around the rig floor 7. The cellar deck 8 is usually one or two floors below the rig floor 7, and is typically the lowermost level on the vessel. The vessel is often referred to as the rig even if this term traditionally is used for the drilling module, whether on land or at sea.

The lubricator pipe 1, injector 2, CT BOP 3 and coiled tubing stripper 4 are lifted by the top drive 5, and a coiled tubing, CT, 11 is connected to the toolstring and pulled up into the lubricator pipe 1. The lubricator pipe 1 is then moved to position and lowered onto a surface flow head 12 and connected. In FIGS. 1, 13 is a subsea Christmas Tree, XMT, 12 is the Through Rotary Surface Flow Head, TRSFH, 14 is a workover riser, WR, and is a lower workover riser package, LRP. Kill and choke lines 16, 17 are also connected to the surface flow head 12. The embodiment shown in FIG. 1 permits rigging of the equipment above the surface flow head without substantial heave thereof, since the surface flow head 12 and the riser 14 hang movably suspended below the rig floor and the equipment to be placed on top thereof is separated from the surface flow head 12 and supported by the rig floor 7 during rigging of said equipment. Typically, according to this embodiment the stack must be rigged down to change the toolstring.

Figure 2:
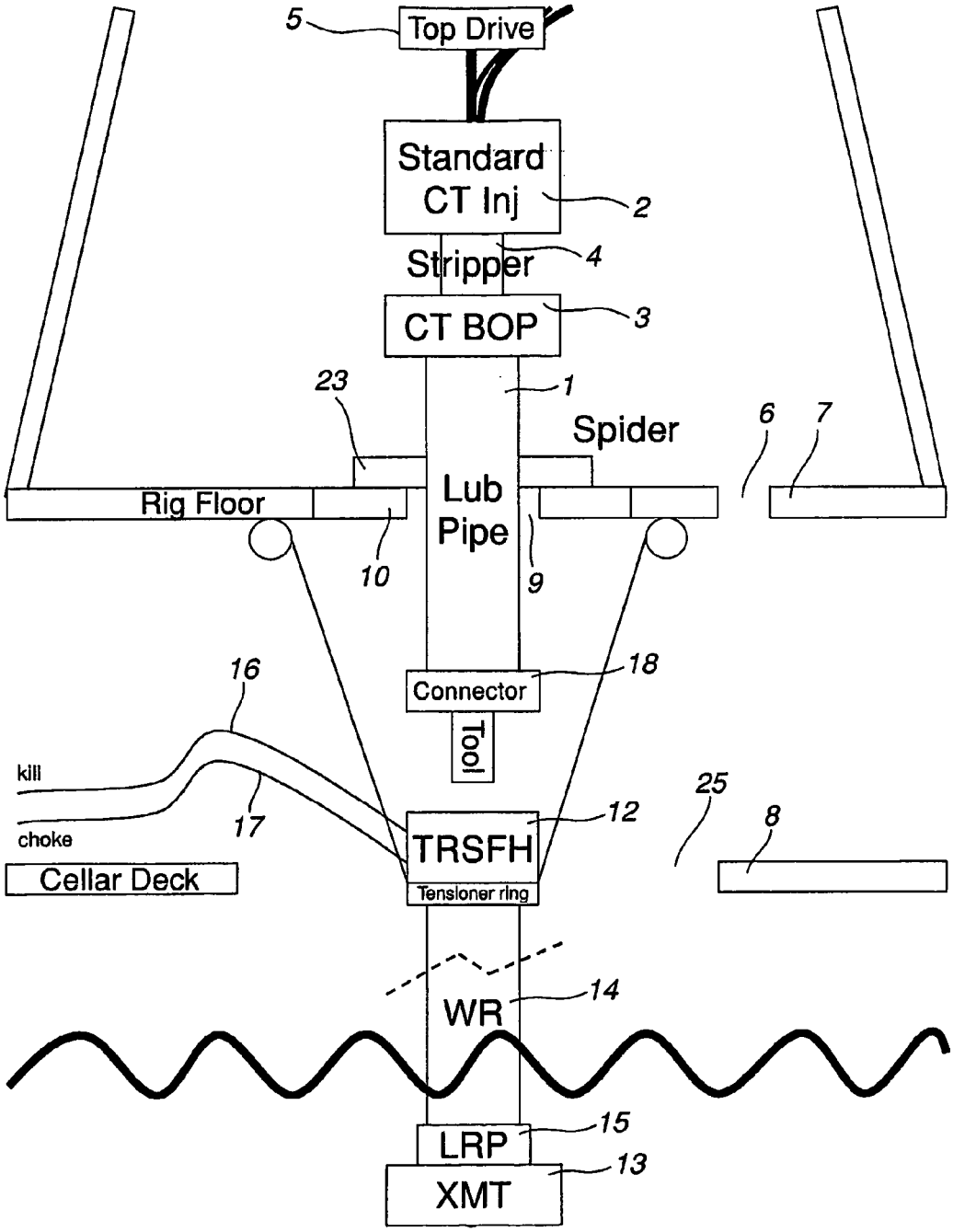
FIG. 2 represents a cross-sectional view of the embodiment shown in FIG. 1 in a rig-up configuration.

FIG. 2 illustrates the embodiment shown in FIG. 1 in a rig-up configuration. The surface flow tree 12 is run on the top drive 5. Then, the injector 2, stripper 4, CT BOP 3 and lubricator pipe 1 with the tool may be run on the top drive 5. Next, the lubricator pipe 1 is connected to the surface flow tree 12 by the aid of a connector 18.

Figure 3:
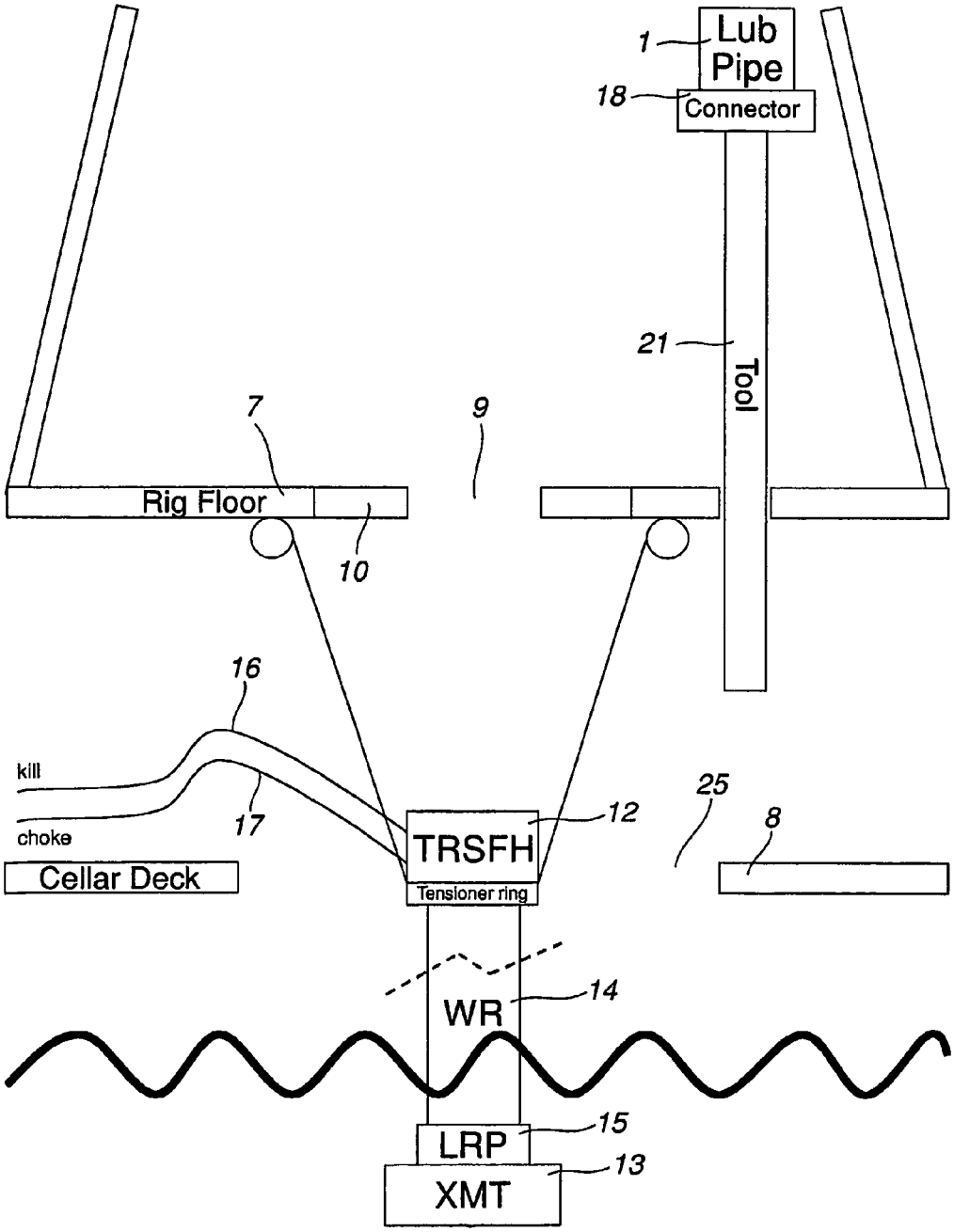
FIG. 3 represents a cross-sectional view of the embodiment shown in FIGS. 1 and 2 showing insertion of a tool string.

FIG. 3 illustrates the embodiment shown in FIG. 1 during insertion (or during change) of a toolstring. To accomplish this, the complete stack must be disconnected from the surface flow tree to change toolstring. The stack and tool are held with the top drive.

Figure 4:
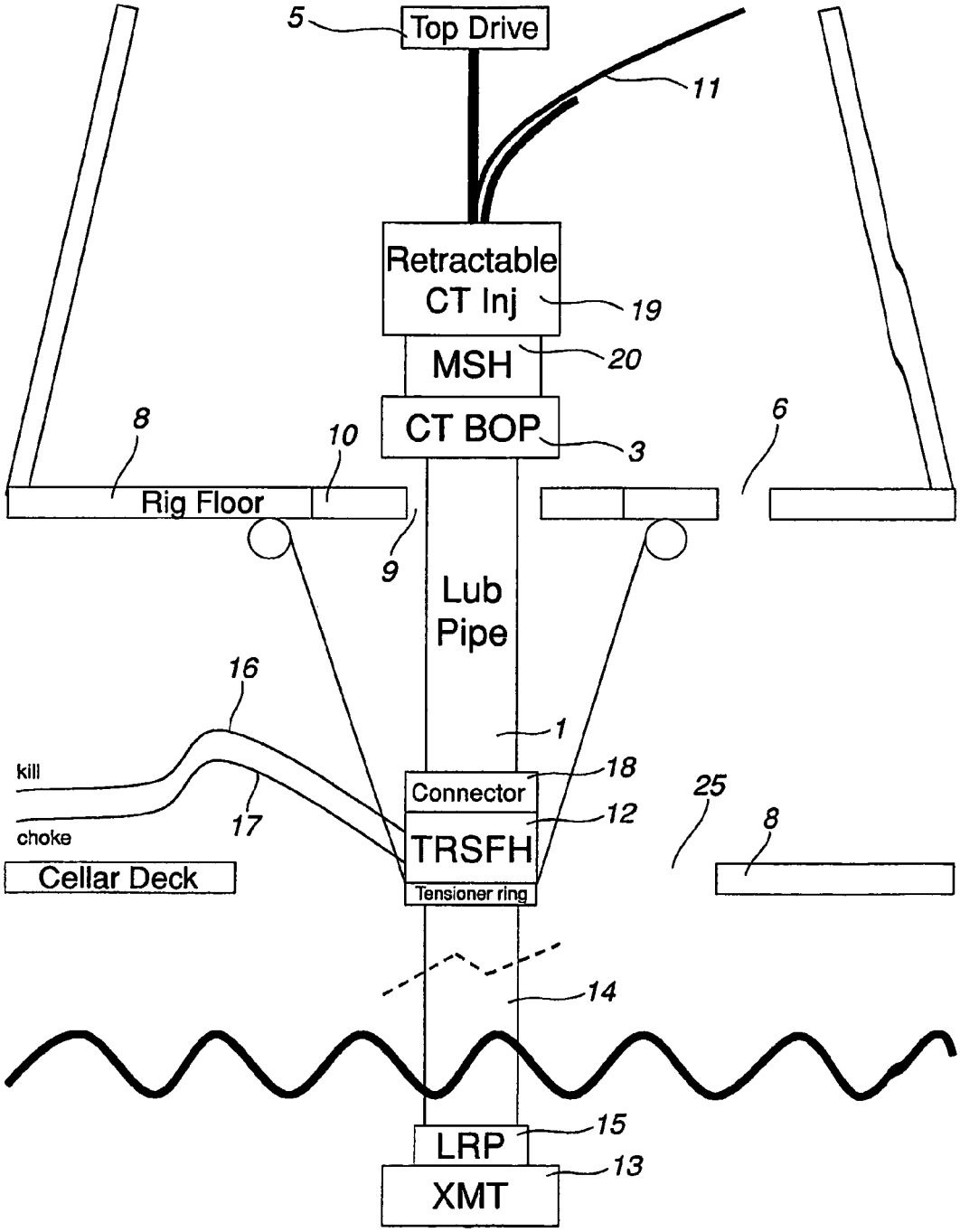
FIG. 4 represents a cross-sectional view of another embodiment of a system according to the present invention.

FIG. 4 illustrates another embodiment of a configuration according to the present invention. This embodiment includes a retractable coiled tubing injector 19 and a Moveable Stripper Assembly (MS) 20 to avoid lifting the coiled tubing blowout preventer (CT BOP) 3 and stripper assembly over the mousehole 6. This can permit longer toolstrings to be employed. According to this embodiment, the toolstring 21 and Moveable Stripper Assembly (MS) 22 are deployed after the lubricator pipe 1 through the injector 19, and the movable stripper 22 landed in the Moveable Stripper Housing (MSH) 20. The CT BOP 3, stripper 22 and injector 19 are connected to the Through Rotary Surface Flow Head (TRSFH) 12 as shown in FIG. 4. This embodiment allows for rigging without substantial heave of the latter components, since they are all disconnected and separated from the movably suspended surface flow head 12 during their rig up. Additionally, the embodiment shown in FIG. 4 permits changing the toolstring with the top drive 5 without rigging down the stack.

Figure 5:
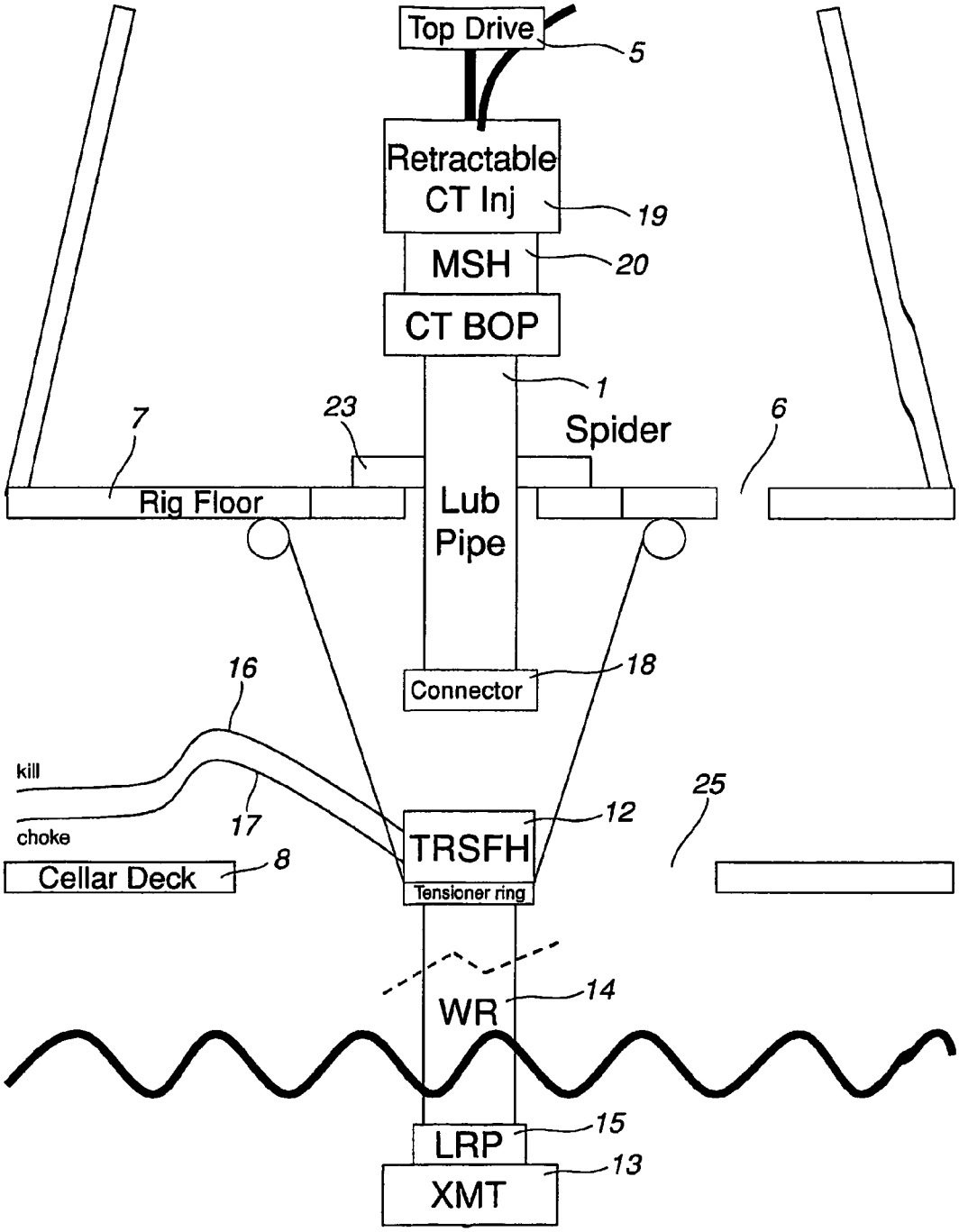
FIG. 5 represents a cross-sectional view of embodiment shown in FIG. 4 in a rig-up configuration.

FIG. 5 illustrates the embodiment shown in FIG. 4 in a rig-up configuration. The surface flow head 12 is run on the top drive 5. The injector 19, stripper housing 20, CT BOP 3 and lubricator pipe 1 may then be run on the top drive 5. The lubricator pipe 1 is connected to the surface flow head 12 through a connector 18, as in the previous embodiment.

Figure 6:
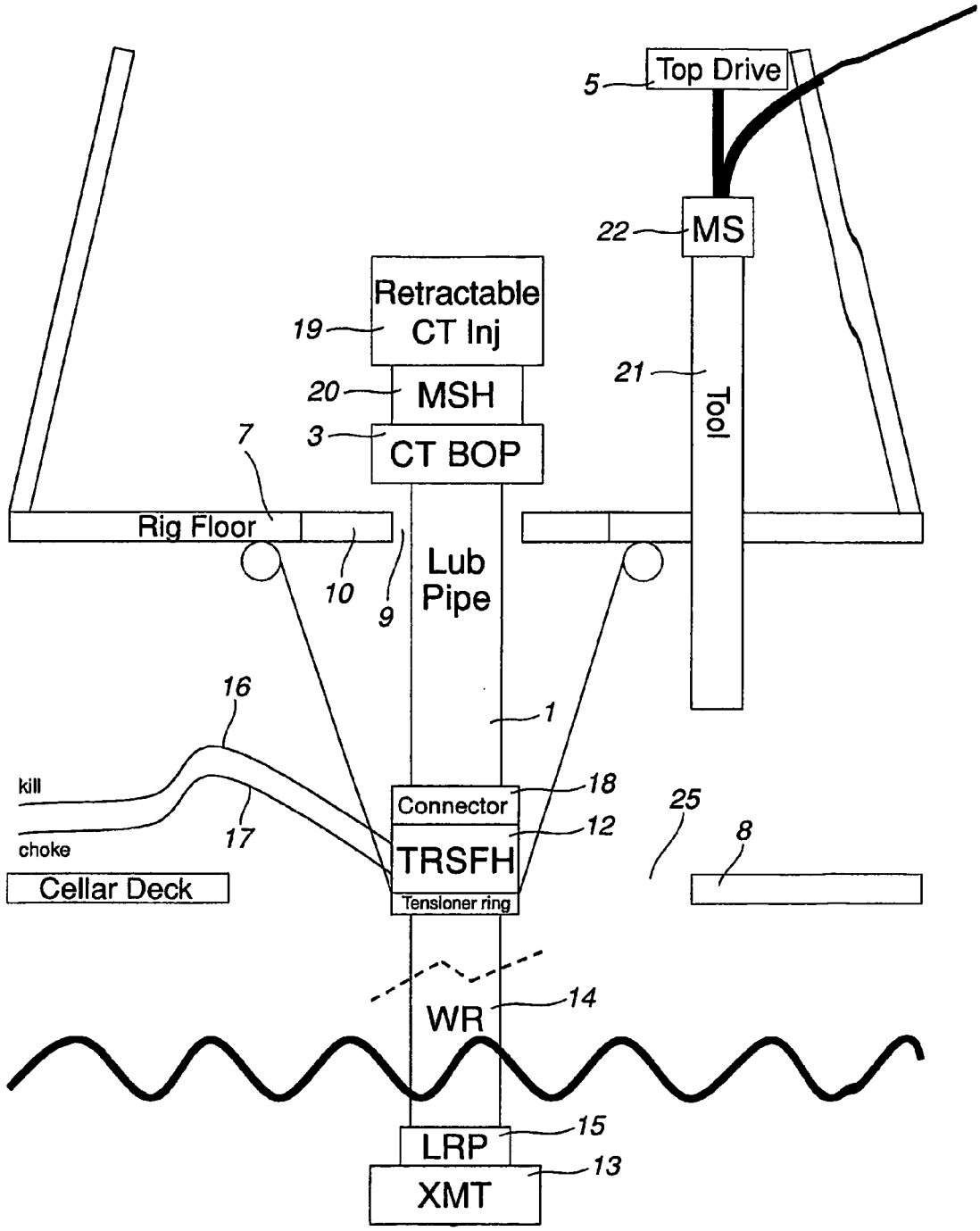
FIG. 6 represents a cross-sectional view of the embodiment shown in FIGS. 4 and 5 showing insertion of a tool string.

FIG. 6 illustrates the embodiment shown in FIG. 4 during insertion of a toolstring. The toolstring 21 is held with the top drive 5 for rigging of the tool in the mousehole 6.

Figure 7:
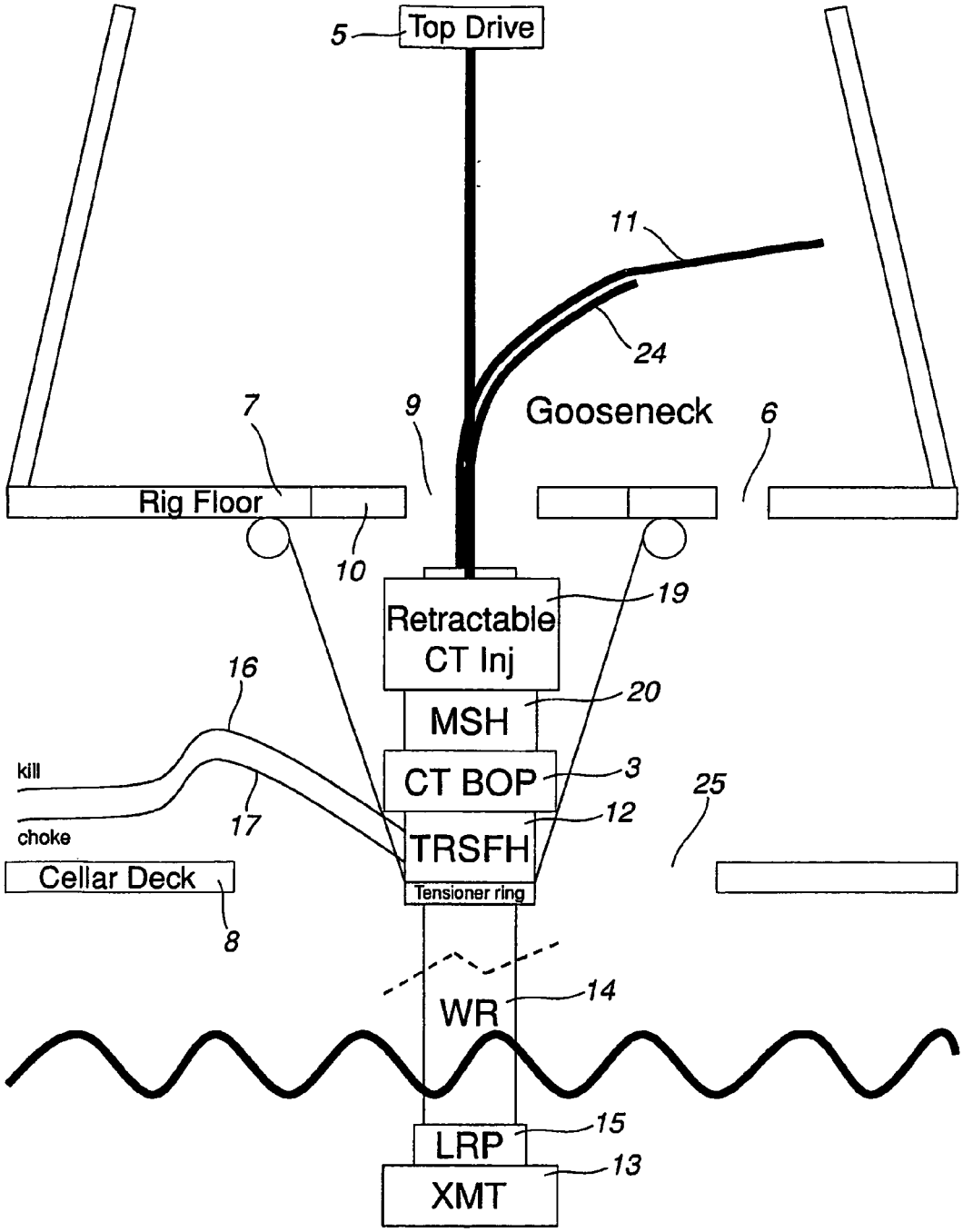
FIG. 7 represents a cross-sectional view of a further embodiment of a system according to the present invention.

FIG. 7 illustrates another embodiment of a system according to the present invention. This embodiment may be employed if sufficient space and a lifting arrangement, such as a drilling blowout preventer (BOP) fork, are available on the cellar deck 8. According to this embodiment, the CT retractable injector 19, the CT BOP 3 and the moveable stripper housing 20 as described above, are inserted at the cellar deck 8. As a result, only toolstrings 21 and the coil gooseneck 24 will then need to be handled at the rig floor level. This embodiment permits rigging substantially without heave and allows changing the toolstring 21 with the top drive 5 without rigging down stack. Typically, the embodiment shown in FIG. 7 offers no or almost no heave at any time at the rig floor 7.

Figure 8:
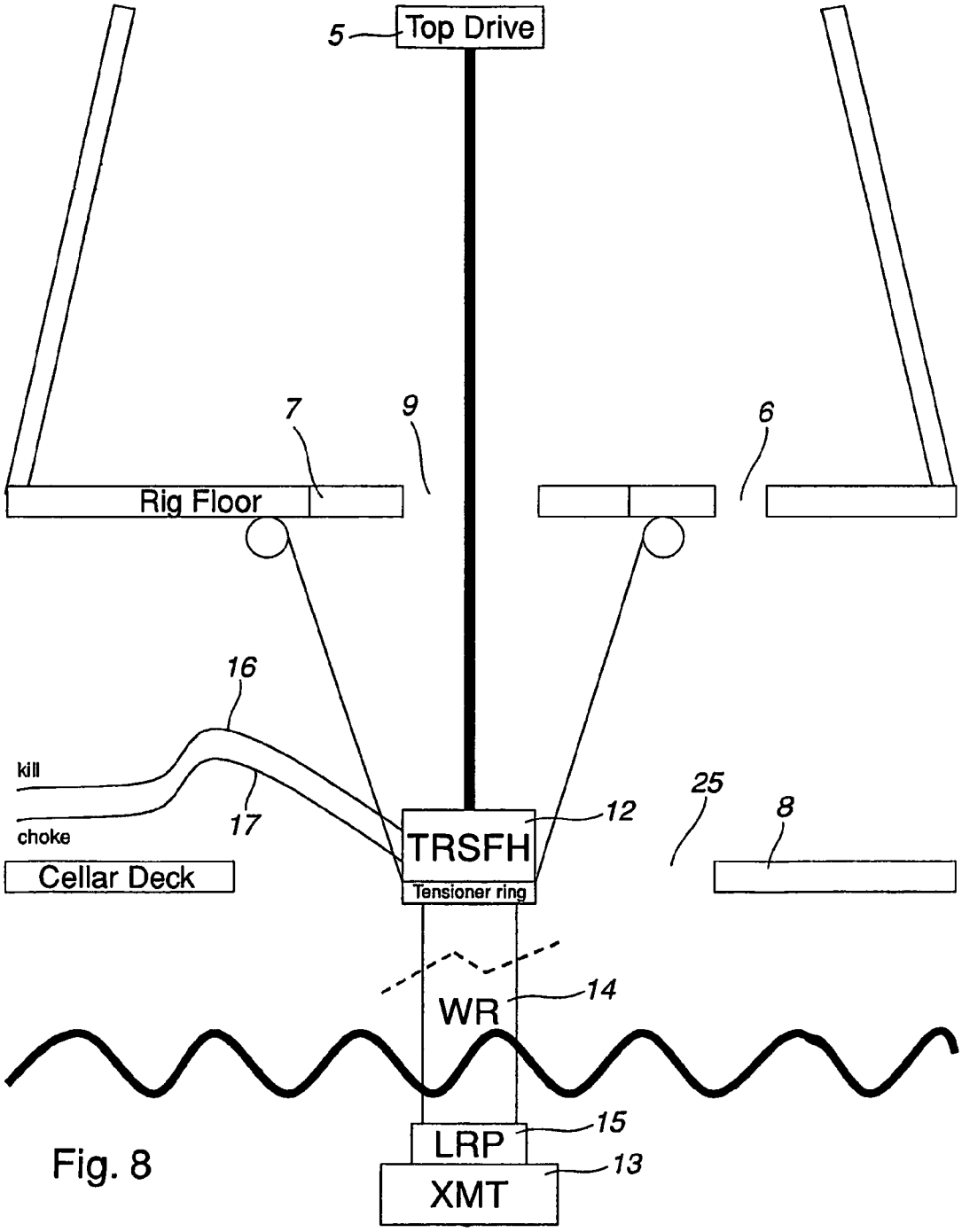
FIG. 8 represents a cross-sectional view of embodiment shown in FIG. 7 in the first part of the rig-up sequence.
Figure 9:
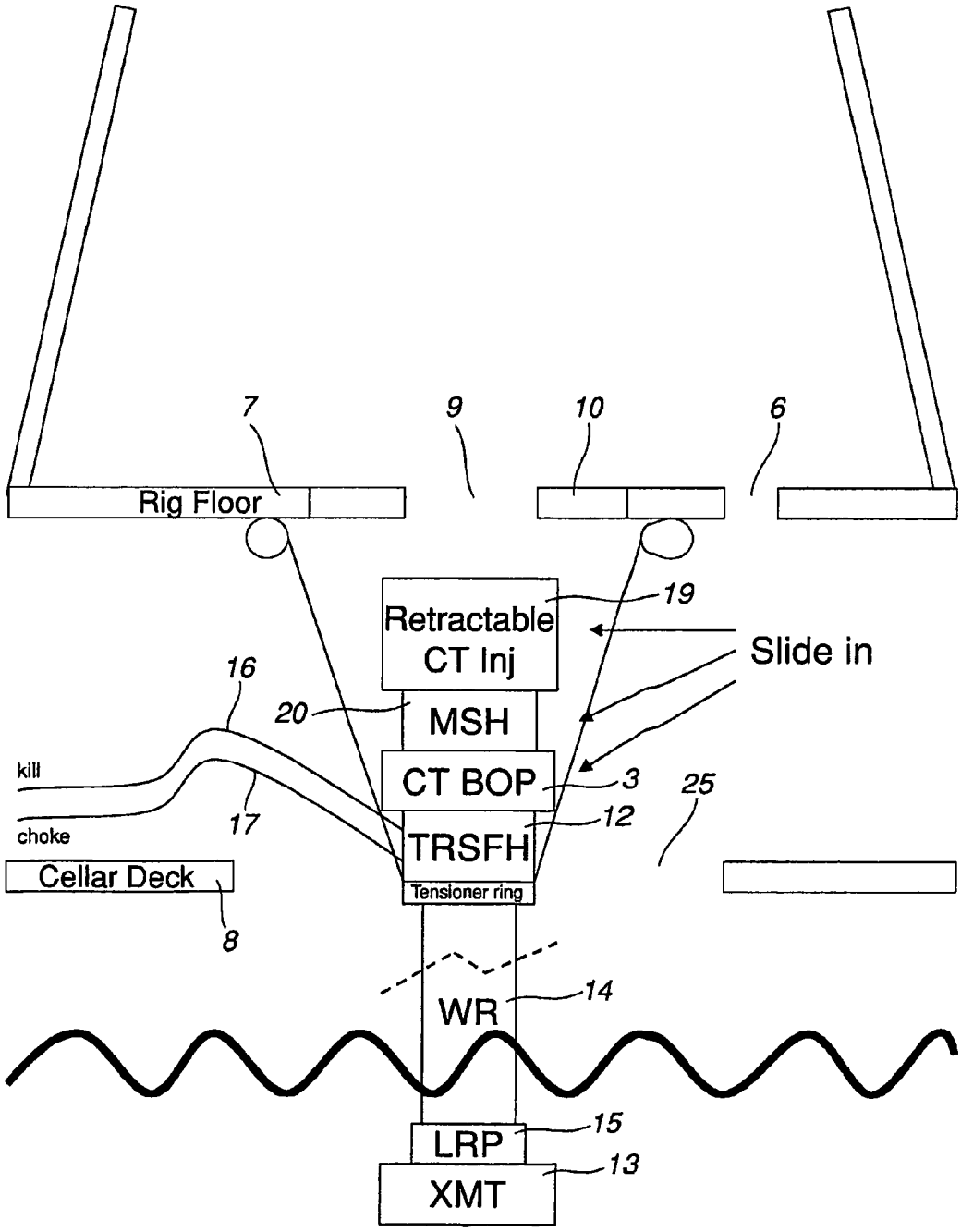
FIG. 9 represents a cross-sectional view of the embodiment shown in FIG. 7 showing the second part of the rig-up sequence.
Figure 10:
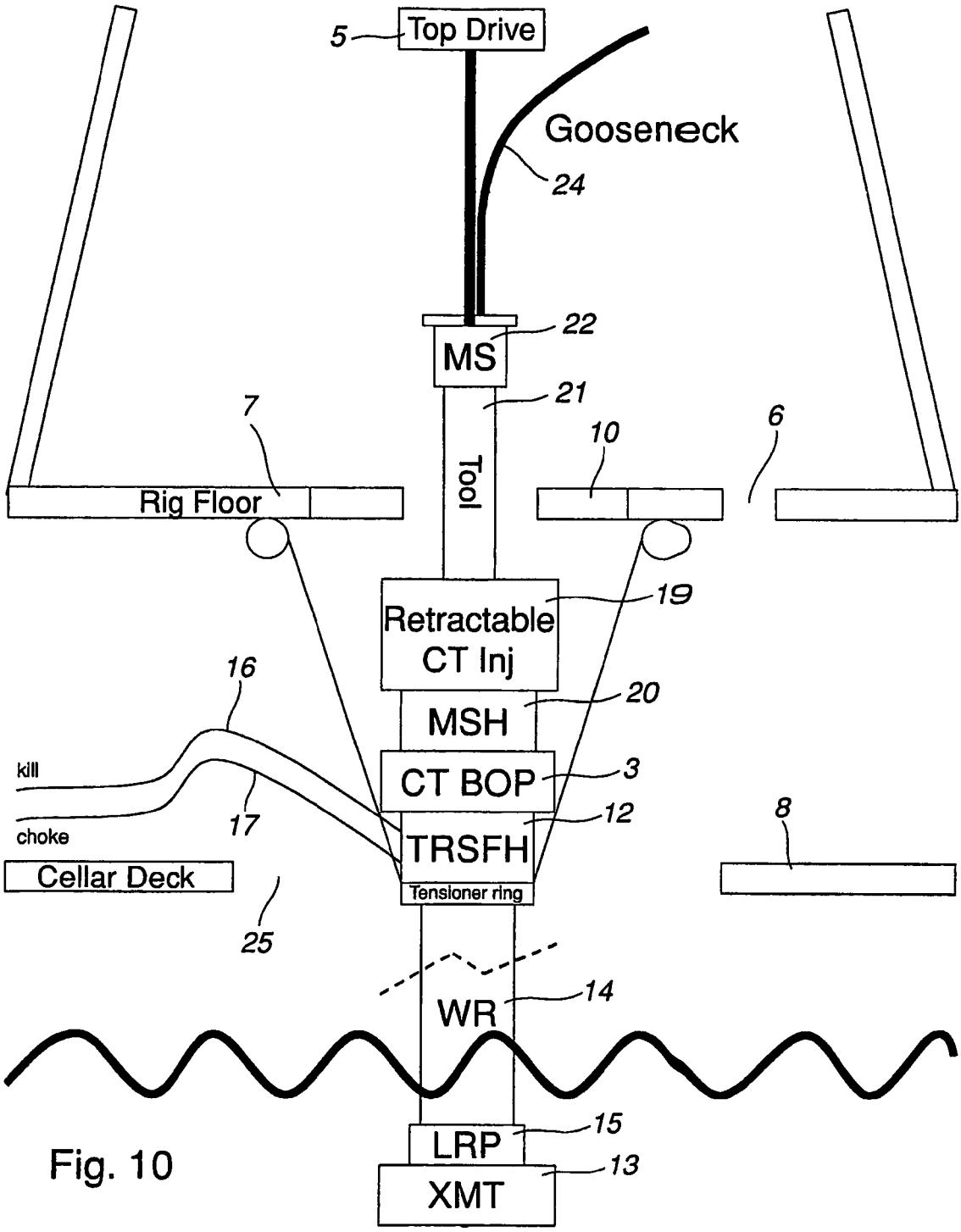
FIG. 10 represents a cross-sectional view of the embodiment shown in FIG. 7 showing the third part of the rig-up sequence.

FIGS. 8-10 illustrate alternative rig-up configurations that may be utilized with the embodiment of FIG. 7. In the example shown in FIG. 8, the surface flow head 12 is run on top drive. In the alternative shown in FIG. 9, the CT BOP 3, MSH 20 and retractable injector 19 are slided in over the moonpool 25, which is the opening in the cellar deck 8 right under the opening 9 in the rotary table 10 on the rig floor 7. On the other hand, in the embodiment shown in FIG. 10, the lubricator pipe is run with the tool string inside on the top drive. The lubricator pipe is connected to the MSH and the tool run into the well. The lubricator pipe and injector 3 may be disconnected and hung off.

FIGS. 8-10 illustrate the rig-up sequence that may be utilized with the embodiment of FIG. 7. In the example shown in FIG. 8, the surface flow head 12 is run on top drive 5. In FIG. 9, the well barrier package/coiled tubing blowout preventer 3, MSH 20 and retractable injector 19 may be slided in over the moonpool 25, and attached to the surface flow head 12. The embodiment of FIG. 10 shows how the tool string 21 together with the MS 22 is run through the retractable CT injector 19 assisted by a guiding structure (not shown). The equipment is suspended from the top drive 5. The belts of the retractable lubricator are moved aside (i.e. retracted) in order to let the toolstring 21 and MS 22 pass through. A guiding structure (not shown) assists the toolstring 21 down through the MSH, CT BOP and SFT. The MS 22 is connected to the MSH 20. The retractable injector belts are moved back in place in order to grip the CT, which is then pushed downwards and the tool run into the well. The guiding structure required may be regarded as a simplified alternative to a lubricator pipe, the meaning of which is to guide the tool into the workover riser 14.

The Through Rotary Surface Flow Head 12 may include full-bore valves that are ball valves and/or gate valves. Also, Through Rotary Surface Flow Head 12 may include kill and choke valves that have a compact design such that they may be connected directly to a high-pressure connector. Alternatively, the invention may include a high pressure connector that can connect kill and choke valves with corresponding hoses. Additionally, it may be necessary to reduce the size of kill and choke valves that may be included in the Through Rotary Surface Flow Head 12.

An alternative to breaking connection above the surface flow head, is to use a high-pressure telescopic joint.

Figure 11:
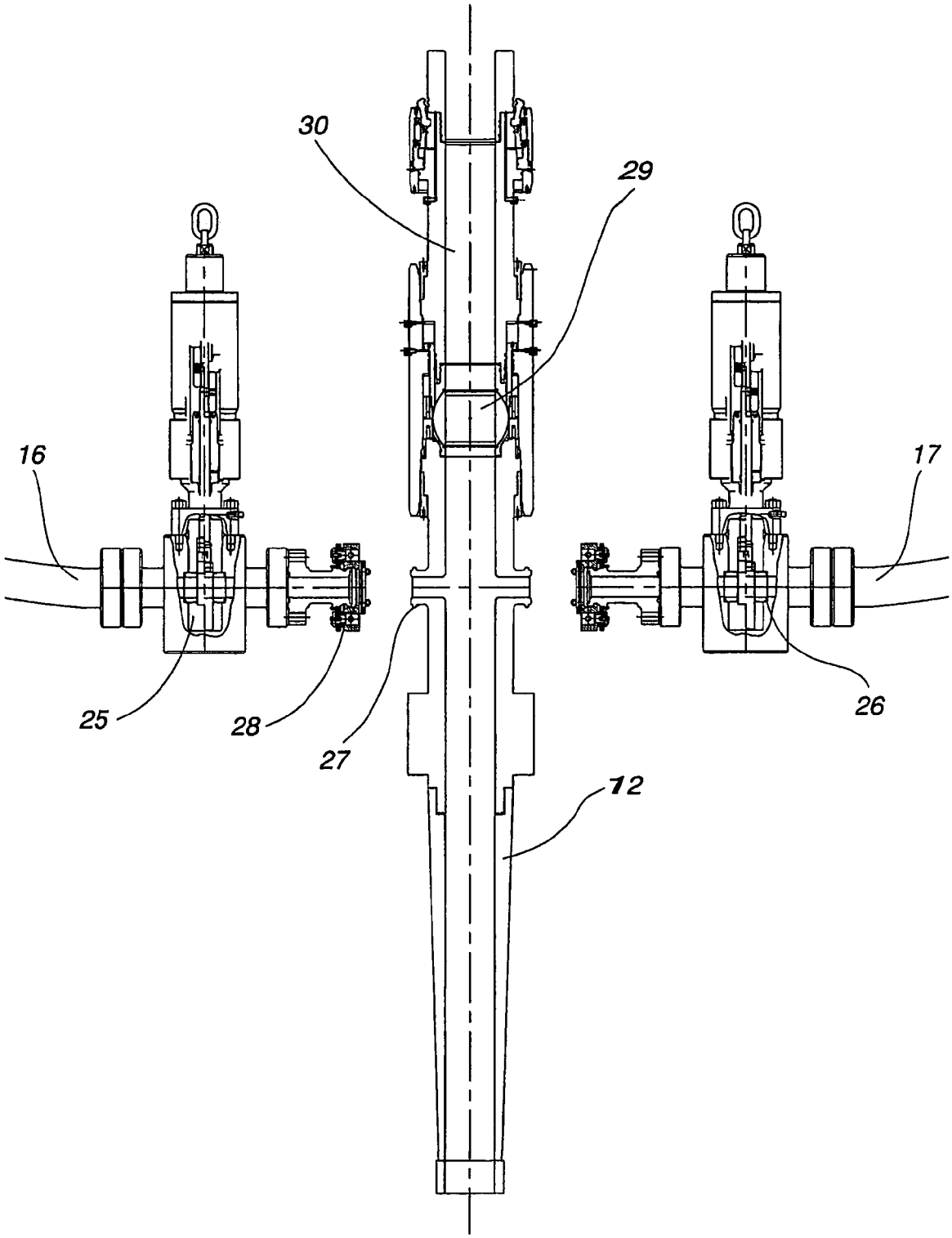
FIG. 11 represents a cross-sectional side view of a surface flow head according to the invention with kill and choke lines to be connected thereto.

A preferred embodiment of a surface flow head 12 according to the invention is shown in FIG. 11. The choke and kill valves 25, 26 have been moved from the surface flowhead 12 to and are included in the kill and choke lines 16, 17. The bulky flanges used to connect valves to the SFH 12 has been replaced with a hub and connector design, in which the hub 27 is quite small and located on the SFH 12 and the more bulky connector 28 is placed on the kill and choke hose. As opposed to a standard API type flange with studs and nuts, the chosen connectors are remote operated and is connected in a much quicker and neater manner than a flanged connection with no need for manual labour in the moonpool over open sea. Moreover, the SFH 12 according to FIG. 11 has a ball valve in the main bore 30, instead of a bulkier gate valve.

The inventive system is suitable for all kind of water depth applications, i.e. for shallow, medium as well as for deep water applications. Subsea intervention operations with the inventive assembly are typically performed at water depths in the interval 100 to 1500 m, although the method may be extended to deeper waters if desired.

It should be realised that the invention has been shown by way of example by means of the above described embodiments. A number of alternative embodiments will therefore be obvious for a person skilled in the art without going beyond the scope of the invention as described herein and illustrated in the annexed drawings.

For example, whereas embodiments in which a coiled tubing, a coiled tubing injector and a CT BOP are used have been described above, it should be understood that alternative embodiments in which a wire line is used instead of a coiled tubing are also conceived and within the scope of the invention. Then the CT injector can be left out, and the CT BOP could be replaced by a well barrier package adapted for use of wire line. Accordingly, the invention also includes any such embodiments.

The invention claimed is:

1. A gas and oil recovery system for rigging up well workover equipment, comprising:

a vessel, platform or rig, with a rig floor, a riser comprising a pipe that extends from the vessel, platform or rig to a x-mas tree on top of a well head and via which a wire or coiled tubing is fed down into a well, said riser being movable through an opening in said rig floor, a surface flow head connected to the riser, wherein the surface flow head is arranged to be run through the opening of the rig floor, and wherein the surface flow head is supported below the rig floor, and a coiled tubing unit and a stripper assembly removably attached on top of the surface flow head, thereby permitting the coiled tubing unit and the stripper assembly to be separated from the surface flow head and supported on the rig floor during rigging up, such that the coiled tubing unit and the stripper assembly are immobile with respect to the vessel, platform or rig during rigging up.

2. The gas and oil recovery system according to claim 1, further comprising:

a cellar deck below the rig floor at the level of which the connection of the kill and choke lines to the surface flow head is to take place.

3. The gas and oil recovery system according to claim 1, wherein the coiled tubing unit comprises a retractable coiled tubing injector and a moveable stripper assembly connected to and on top of the surface flow head.

4. The gas and oil recovery system according to claim 3, wherein the moveable stripper assembly is connected to the surface flow head through a well barrier package and a lubricator pipe.

5. The gas and oil recovery system according to claim 2, further comprising:

a lifting arrangement on the cellar deck for lifting at least one of a coiled tubing injector, a moveable stripper housing, and a coiled tubing blow out preventer onto or off from the surface flow head at the cellar deck level.

6. The gas and oil recovery system according to claim 2, further comprising:

a sliding arrangement at the cellar deck level, for sliding at least one of a coiled tubing injector, a moveable stripper housing, and a coiled tubing blow out preventer onto and off from the surface flow head at the cellar deck level.

7. The gas and oil recovery system according to claim 1, wherein the surface flow head is provided with a swivel that allows it to be rotated independently in relation to the riser.

8. The gas and oil recovery system according to claim 1, wherein the riser is suspended in the rig floor by a riser tensioner connected to the rig floor and to the riser.

9. The gas and oil recovery system according to claim 1, wherein the surface flow head comprises a ball valve arranged in a main bore thereof.

10. The gas and oil recovery system according to claim 1, wherein the surface flow head is provided with outlets provided with connecting means for connection thereof to hoses and valves of a kill line and a choke line respectively.

11. A method of rigging up a gas and oil recovery system comprising a vessel, platform or rig, with a rig floor, a riser comprising a pipe that extends from the vessel, platform or rig to a x-mas tree on top of a well head and via which a wire or coiled tubing is fed down into a well, said riser being movable through an opening in said rig floor, and a surface flow head connected to the riser, the surface flow head is arranged to be run through the opening of the rig floor, and a coiled tubing unit and a stripper assembly, the method comprising:

supporting the coiled tubing unit and stripper assembly on the rig floor during rigging up, such that the coiled tubing unit and stripper assembly are immobile with respect to the vessel, platform or rig during rigging up;

connecting the surface flow head to the riser;

permitting the surface flow head to run through the opening in the rig floor during subsequent operation;

supporting the surface flow head below the rig floor;

removably connecting the coiled tubing unit and stripper assembly on top of the surface flow head; and configuring connections of the surface flow head to connect to hoses and valves of a kill line and a choke line, respectively.

12. The method according to claim 11 further comprising:

positioning a coiled tubing blow out preventer, a stripper, and an injector on top of the surface flow head by lowering through the opening in the rig floor.

13. The method according to claim 11, further comprising:

positioning a retractable coiled tubing injector, a coiled tubing blow out preventer and a moveable stripper housing on top of the surface flow head by lowering through the opening in the rig floor.

14. The method according to claim 11, further comprising:

positioning a retractable coiled tubing injector, a coiled tubing blow out preventer and a moveable stripper housing on top of the surface flow head from a position on a cellar deck level below the rig floor.

15. A gas and oil recovery system for rigging up well workover equipment, comprising:

a vessel, platform or rig, comprising a rig floor;

a riser comprising a pipe that extends from the vessel, platform or rig to a x-mas tree on top of a well head and via which a wire or coiled tubing is fed down into a well, said riser being movable through an opening in said rig floor;

a surface flow head connected to the riser, wherein the surface flow head is arranged to be run through the opening of the rig floor, wherein the surface flow head comprises a ball valve arranged in a main bore thereof, and wherein the surface flow head comprises outlets comprising connections configured to connect the surface flow head to hoses and valves of a kill line and a choke line, respectively, below the ball valve; and a coiled tubing unit and a stripper assembly removably attached on top of the surface flow head, thereby permitting the coiled tubing unit and the stripper assembly to be separated from the surface flow head and supported on the rig floor during rigging up, such that the coiled tubing unit and the stripper assembly are immobile with respect to the vessel, platform or rig during rigging up.

16. A method of rigging up a gas and oil recovery system comprising a vessel, platform or rig, with a rig floor, a riser comprising a pipe that extends from the vessel, platform or rig to a x-mas tree on top of a well head and via which a wire or coiled tubing is fed down into a well, said riser being movable through an opening in said rig floor, and a surface flow head connected to the riser, the surface flow head is arranged to be run through the opening of the rig floor and comprising a ball valve arranged in a main bore thereof and outlets comprising connections configured to connect the surface flow head to hoses and valves of a kill line and a choke line, respectively, below the ball valve, and a coiled tubing unit and a stripper assembly, the method comprising:

supporting the coiled tubing unit and stripper assembly on the rig floor during rigging up, such that the coiled tubing unit and stripper assembly are immobile with respect to the vessel, platform or rig during rigging up;

connecting the surface flow head to the riser;

permitting the surface flow head to run through the opening in the rig floor during subsequent operation;

removably connecting the coiled tubing unit and stripper assembly on top of the surface flow head; and configuring the connections of the surface flow head to connect to hoses and valves of a kill line and a choke line, respectively.

17. A gas and oil recovery system for rigging up well workover equipment, comprising:

a vessel, platform or rig, with a rig floor, a riser comprising a pipe that extends from the vessel, platform or rig to a x-mas tree on top of a well head and via which a wire or coiled tubing is fed down into a well, said riser being movable through an opening in said rig floor, a surface flow head connected to the riser, wherein the surface flow head is arranged to be run through the opening of the rig floor, wherein the surface flow head comprises a valve arranged in a main bore thereof, and wherein the surface flow head comprises outlets comprising connections configured to connect the surface flow head to hoses and valves of a kill line and a choke line, respectively, below the valve, and a coiled tubing unit and a stripper assembly removably attached on top of the surface flow head, thereby permitting the coiled tubing unit and the stripper assembly to be separated from the surface flow head and supported on the rig floor during rigging up, such that the coiled tubing unit and the stripper assembly are immobile with respect to the vessel, platform or rig during rigging up.

18. A method of rigging up a gas and oil recovery system comprising a vessel, platform or rig, with a rig floor, a riser comprising a pipe that extends from the vessel, platform or rig to a x-mas tree on top of a well head and via which a wire or coiled tubing is fed down into a well, said riser being movable through an opening in said rig floor, and a surface flow head connected to the riser, the surface flow head is arranged to be run through the opening of the rig floor, wherein the surface flow head comprises a valve arranged in a main bore thereof, and a coiled tubing unit and a stripper assembly, the method comprising:

supporting the coiled tubing unit and stripper assembly on the rig floor during rigging up, such that the coiled tubing unit and stripper assembly are immobile with respect to the vessel, platform or rig during rigging up;

connecting the surface flow head to the riser;

permitting the surface flow head to run through the opening in the rig floor during subsequent operation;

removably connecting the coiled tubing unit and stripper assembly on top of the surface flow head; and configuring connections of the surface flow head to connect to hoses and valves of a kill line and a choke line, respectively, below the valve.

* * * * *